US007917051B2

(12) United States Patent
Kusakabe

(10) Patent No.: US 7,917,051 B2
(45) Date of Patent: Mar. 29, 2011

(54) IMAGE FORMING APPARATUS

(75) Inventor: Kazushi Kusakabe, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/814,013

(22) Filed: Jun. 11, 2010

(65) Prior Publication Data

US 2010/0322662 A1 Dec. 23, 2010

(30) Foreign Application Priority Data

Jun. 18, 2009 (JP) ..... 2009-144822

(51) Int. Cl.
*G03G 21/20* (2006.01)
*G03G 21/00* (2006.01)

(52) U.S. Cl. ..... 399/92; 399/99

(58) Field of Classification Search ..... 399/91–93, 399/98, 99, 101
See application file for complete search history.

(56) References Cited

U.S. PATENT DOCUMENTS

| | | | | |
|---|---|---|---|---|
| 7,403,732 | B2 * | 7/2008 | Shimazu et al. | 399/92 |
| 2005/0244178 | A1 * | 11/2005 | Kitayama | 399/49 |
| 2007/0059024 | A1 * | 3/2007 | Kitayama | 399/92 |
| 2008/0101816 | A1 * | 5/2008 | Nogami | 399/92 |

FOREIGN PATENT DOCUMENTS

| | | | |
|---|---|---|---|
| JP | 2002-278387 | A | 9/2002 |
| JP | 2004-272144 | A | 9/2004 |
| JP | 2005-258275 | A | 9/2005 |

* cited by examiner

*Primary Examiner* — David P Porta
*Assistant Examiner* — Jessica L Eley
(74) *Attorney, Agent, or Firm* — Buchanan Ingersoll & Rooney PC

(57) ABSTRACT

An image forming apparatus wherein a printing medium can be prevented from being stained with toner leaking out of a developing device. As a photosensitive drum rotates in a direction, an air flow in the rotating direction is generated around the photosensitive drum. Guides that define a part of a sheet path are disposed to guide a sheet to between a transfer roller and the photosensitive drum. The guides are located in positions downstream from the developing device and upstream from the transfer roller with respect to the rotating direction of the photosensitive drum and face the photosensitive drum. A fan is disposed to generate an air flow passing below the guides. An air passage for directing part of the air flow generated around the photosensitive drum to the air flow passing below the guides is made in a position upstream from the sheet path and downstream from the developing device with respect to the rotating direction of the photosensitive drum.

5 Claims, 6 Drawing Sheets

IMAGE FORMING APPARATUS

This application is based on Japanese Patent Application No. 2009-144822 filed on Jun. 18, 2009, the content of which is incorporated herein by reference.

BACKGROUND OF THE INVENTION

1. Field of the Invention

The present invention relates to an image forming apparatus, and more particularly to an image forming apparatus that transfers a toner image to a printing medium.

2. Description of Related Art

For example, image forming apparatuses disclosed by Japanese Patent Laid-Open Publication No. 2005-258275 (Reference 1) and Japanese Patent Laid-Open Publication No. 2004-272144 (Reference 2) are well known. These image forming apparatuses are structured with an intension of preventing a printing medium from being stained with toner leaking out from a developing device. The image forming apparatuses disclosed by these documents are briefly described in the following.

The image forming apparatus disclosed by the Reference 1 has a structure to keep the inside of a developing device in a negative pressure. The image forming apparatus disclosed by the Reference 2 has a structure to prevent occurrence of an air flow from a developing device to the outside thereof. In the image forming apparatuses with the structures, toner leakage from the developing devices is suppressed.

Thus, the References 1 and 2 discuss suppression of toner leakage out from a developing device, while not discussing prevention of a printing medium from being stained with toner leaking out from a developing device.

SUMMARY OF THE INVENTION

An object of the present invention is to provide an image forming apparatus wherein a printing medium can be prevented from being stained with toner leaking from a developing device.

An image forming apparatus according to an embodiment of the present invention comprises: a photosensitive drum that rotates in a specified direction; a developing device for forming a toner image on a surface of the photosensitive drum; a transfer member for transferring the toner image from the photosensitive drum to a printing medium passing between the photosensitive drum and the transfer member; a first guide, which is disposed in a position downstream from the developing device and upstream from the transfer device with respect to the specified direction to face the photosensitive drum, for guiding the printing medium to between the transfer member and the photosensitive drum; an air flow generator for generating an air flow in a position that is different from a position where a first air flow along the surface of the photosensitive drum is generated by the rotation of the photosensitive drum; and an air passage, which is disposed upstream from a path of the printing medium and downstream from the developing device with respect to the specified direction, for directing part of the first air flow to the second air flow.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Image forming apparatuses according to preferred embodiments of the present invention are described with reference to the drawings.

General Structure of the Image Forming Apparatus

Figure 1:
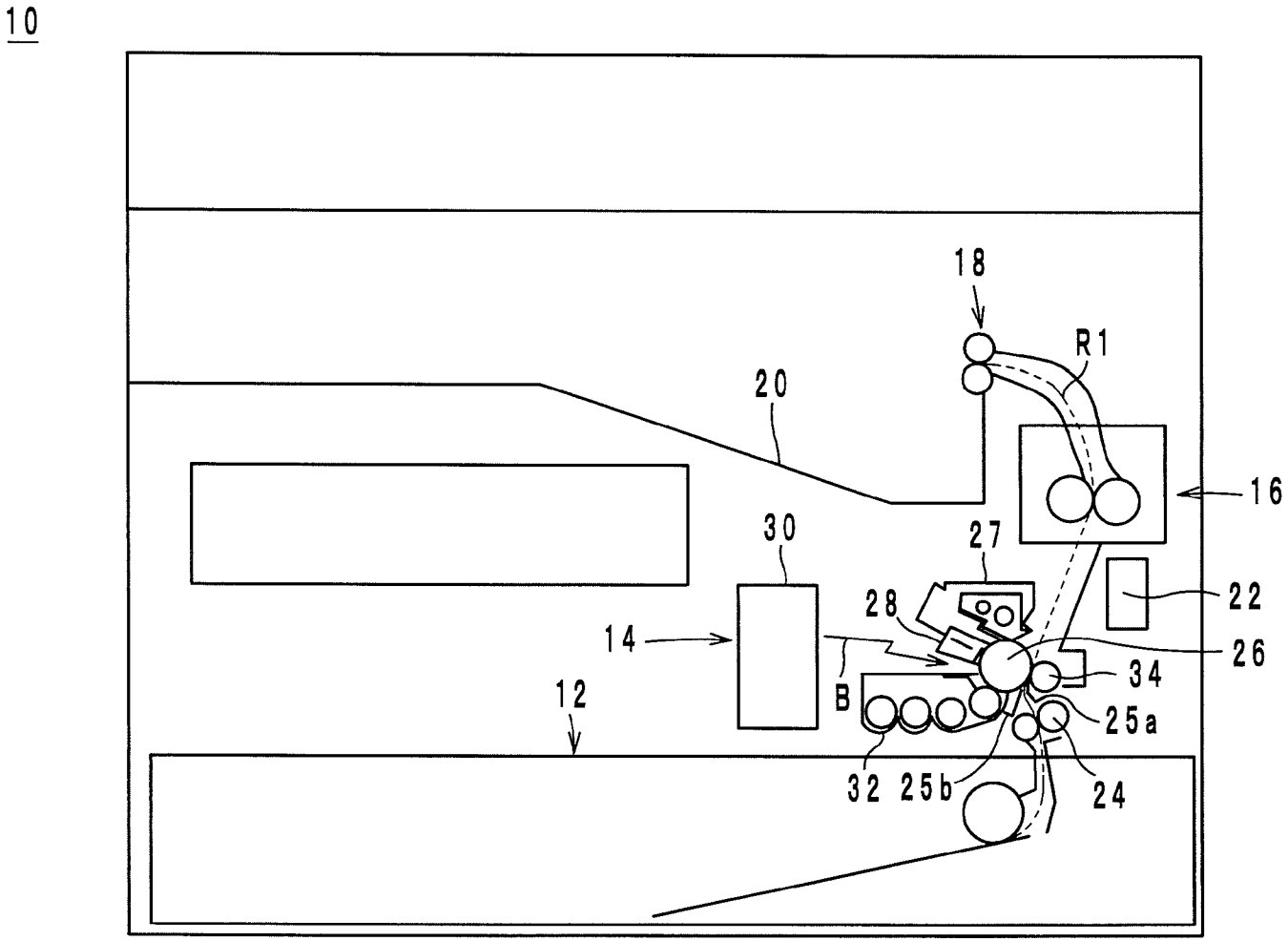
FIG. 1 is a schematic view of an image forming apparatus according to an embodiment of the present invention.
Figure 2:
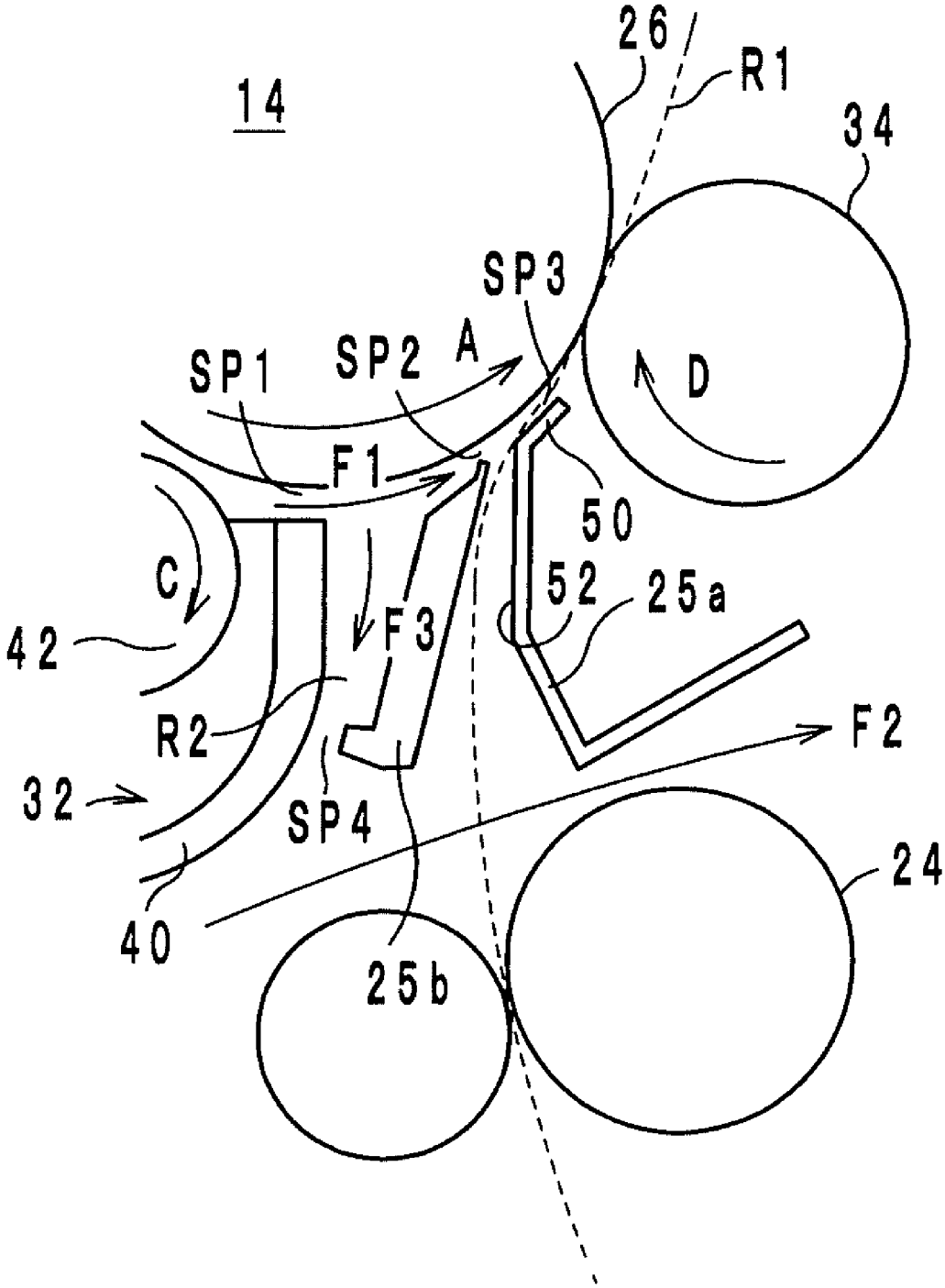
FIG. 2 is an enlarged view of an image forming unit employed in the image forming apparatus shown by FIG. 1.

First, an image forming apparatus according to an embodiment of the present invention is described with reference to the drawings. FIG. 1 shows an image forming apparatus 10 according to an embodiment. FIG. 2 is an enlarged view of an image forming unit 14 employed in the image forming apparatus 10. In the following paragraphs, a front side of a sheet means the side of a sheet on which an image is to be printed, and a reverse side of a sheet means the side of a sheet on which an image is not to be printed.

The image forming apparatus 10 is an electrophotographic copying machine or printer. The image forming apparatus 10, as shown by FIG. 1, comprises a sheet feed unit 12, an image forming unit 14, a fixing unit 16, a pair of ejection rollers 18, an ejected-sheet tray 20 and a fan 22. The sheet feed unit 12 is stored with a stack of sheets (of a printing medium) and feeds the sheets to the image forming unit 14 one by one with a feed roller.

The image forming unit 14 is to form a toner image on a sheet. The image forming unit 14 comprises a pair of timing rollers 24, guides 25*a* and 25*b*, a photosensitive drum 26, a cleaner 27, a charger 28, an optical scanning device 30, a developing device 32 and a transfer roller 34. A detailed description of the image forming unit 14 will be given later.

The fixing unit 16 comprises a pair of fixing rollers and practices a heat treatment and a pressure treatment to a sheet traveling between the fixing rollers. Thereby, the toner image formed on the sheet is fixed thereon. The pair of ejection rollers 18 ejects a sheet fed from the fixing unit 16 onto the ejected-sheet tray 20. Thereby, sheets with images printed thereon are stacked on the ejected-sheet tray 20.

The fan (an air flow generator) 22 cools the inside of the image forming apparatus 10 by exhausting air from the image forming apparatus 10 to the outside. As shown in FIG. 1, the fan 22 is disposed in a position downstream from the image forming unit 14 in a sheet feeding direction. The operation of the fan 22 causes an air flow, which will be described later, inside the image forming apparatus 10.

Next, the image forming unit 14 is described in more detail, referring to FIGS. 1 and 2. The photosensitive drum 26 is cylindrical and functions as a toner image bearing member. The photosensitive drum 26 is driven by a motor (not shown) to rotate, as shown in FIG. 2, in a direction shown by arrow "A" (in the counterclockwise direction).

The charger 28 is disposed to face the surface of the photosensitive drum 26 as shown in FIG. 1 and charges the surface of the photosensitive drum 26. As shown in FIG. 1, the optical scanning device 30 is disposed in a position downstream from the charger 28 in the direction "A" to face the photosensitive drum 26. The optical scanning device 30 is controlled by a control section (not shown) in accordance with image data outputted from an image reader (scanner) or a computer and emits a beam "B" to the surface of the photosensitive drum 26. Thereby, an electrostatic latent image is formed on the surface of the photosensitive drum 26.

As shown in FIG. 1, the developing device 32 is disposed in a position downstream from the optical scanning device 30 in the direction "A" to face the photosensitive drum 26. The developing device 32 forms a toner image on the surface of the photosensitive drum 26. As shown in FIG. 2, the developing device 32 comprises a case 40 and a developing roller 42. Toner is contained in the case 40. As shown in FIG. 2, the case 40 faces the photosensitive drum 26 keeping out of contact with the photosensitive drum 26, and more particularly, there is a small gap SP1 between the case 40 and the photosensitive drum 26.

The developing roller 42 is located inside the case 40 as shown in FIG. 2 and is cylindrical. The developing roller 42 is partly uncovered from the case 40 and therefore faces the surface of the photosensitive drum 26. The developing roller 42 is driven by a motor (not shown) to rotate in a direction shown by arrow "C" (in the clockwise direction) and supplies toner to the photosensitive drum 26. Thereby, a toner image in accordance with the electrostatic latent image is formed on the surface of the photosensitive drum 26. The developing device further comprises a supply roller and other components, but descriptions of these components are omitted.

As shown in FIG. 2, the transfer roller 34 is disposed in a position downstream from the developing device 32 in the direction "A" to face the photosensitive drum 26. The transfer roller 34 transfers a toner image to a sheet that is traveling between the transfer roller 34 and the photosensitive drum 26. The transfer roller 34 is driven by a motor (not shown) to rotate in a direction shown by arrow "D" (in the clockwise direction) as shown in FIG. 2.

As shown in FIG. 1, the cleaner 27 is disposed in a position downstream from the transfer roller 34 in the direction "A" to face the photosensitive drum 26. The cleaner 27 collects residual toner from the surface of the photosensitive drum 26.

The pair of timing rollers 24, as shown in FIG. 2, feeds a sheet fed out of the sheet feed unit 12 to the photosensitive drum 26 and the transfer roller 34. The guides 25*a* and 25*b* are disposed in positions downstream from the developing device 32 and upstream from the transfer roller 34 with respect to the direction "A". The guides 25*a* and 25*b* guide a sheet fed by the timing rollers 24 to between the photosensitive drum 26 and the transfer roller 34. The sheet is fed along a sheet path R1 between the sheet feed unit 12 and the pair of ejection rollers 18. The guide 25*a* has a guide wall 52. As shown in FIG. 2, the guide wall 52 and the guide 25*b* face to each other and define a part of the sheet path R1. The guide 25*a* (guide wall 52) is disposed to face the reverse side of a sheet traveling along the sheet path R1, and the guide 25*b* is disposed to face the front side of a sheet traveling along the sheet path R1. In other words, the guide 25*b* is located in a position downstream from the developing device 32 and upstream from the guide 25*a* (guide wall 52) with respect to the direction "A".

Further, as shown in FIG. 2, the downstream edge 50 (with respect to the sheet feeding direction) of the guide 25*a* faces the photosensitive drum 26 keeping a small gap SP3 from the photosensitive drum 26. Thereby, the guide 25*a* (the edge 50) and the photosensitive drum 26 define a part of the sheet path R1. The sheet path R1 comes between the photosensitive drum 26 and the transfer roller 34 after the gap SP3. Also, the downstream edge (with respect to the sheet feeding direction) of the guide 25*b* faces the photosensitive drum 26 keeping a small gap SP2 from the photosensitive drum 26 so as to keep out of contact with the photosensitive drum 26.

When the image forming apparatus 10 operates for printing, the photosensitive drum 26 rotates in the direction "A". At this time, an air flow F1 along the circumference of the photosensitive drum 26 is generated as shown in FIG. 2. The developing roller 42 partly projects from the case 40 to the gap SP1. Therefore, toner adhering to the surface of the developing roller 42 is carried out from the developing device 32 by the air flow F1.

As shown in FIG. 2, the air flow F1 goes through the gaps SP1 to SP3. Accordingly, toner adheres to the guides 25*a* and 25*b* while passing through the gaps SP1 to SP3. The sheet path R1 includes the gap SP3, which is relatively narrow, and if toner adheres to the edge 50 of the guide 25*a*, the reverse side of a sheet may be stained with the toner. In order to avoid this trouble, as will be described later, the image forming apparatus 10 has a structure to prevent toner from adhering to the edge 50 of the guide 25*a*.

More specifically, in the image forming apparatus 10, as shown in FIG. 2, there is a space between the guide 25*b* and the case 40, the space extending substantially in parallel to the sheet path R1. Further, the upstream edge (with respect to the sheet feeding direction) of the guide 25*b* faces the case 40 keeping a gap SP4 from the case 40. Thereby, a flow passage R2 is formed by the guide 25*b* and the case 40 in a position upstream from the sheet path R1 and downstream from the developing device 32 with respect to the direction "A". The flow passage R2 connects the circumference of the photosensitive drum 26 with a space upstream from the guides 25*a* and 25*b* with respect to the sheet feeding direction.

The operation of the fan 22 generates an air flow F2 in a position different from the position of the air flow F1. More specifically, the air flow F2 passes through a space upstream from the guides 25*a* and 25*b* with respect to the sheet feeding direction. Because of the air flow F2, the air pressure in the space upstream from the guides 25*a* and 25*b* is lower than those in the other spaces (for example, lower than the air pressure in the flow passage R2). Therefore, air flows out of the flow passage R2 through the gap SP4, that is, an air flow F3 as shown in FIG. 2 is generated in the flow passage R2. Thereby, the air flow F1 is partly guided to the air flow F2 via the flow passage R2. In the structure described above, the flow rate of the air flow F1 passing through the gap SP3 decreases, and toner adhesion to the edge 50 of the guide 25*a* can be suppressed.

The air flow F1 comes between the guide 25*a* and the transfer roller 34 after passing through the gap SP3. Then, the air flow F1 joins to the air flow F2. The confluent air flows F1 and F2 are exhausted from the image forming apparatus 10 by the fan 22. At this moment, toner is removed from the exhaust air by a filter or the like.

Analyses

Figure 3:
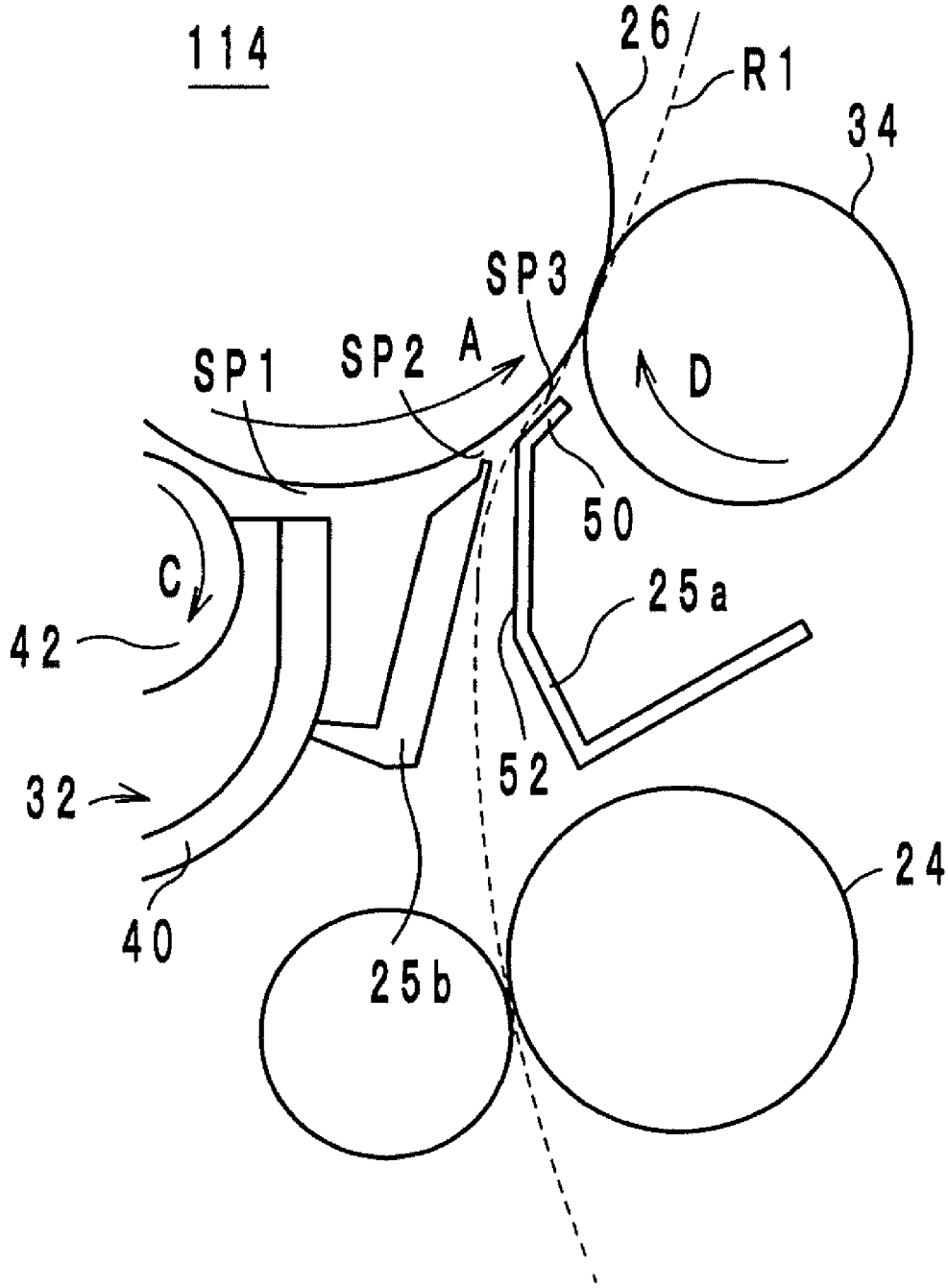
FIG. 3 is an illustration of an image forming unit employed in an image forming apparatus according to a comparative example.
Figure 4:
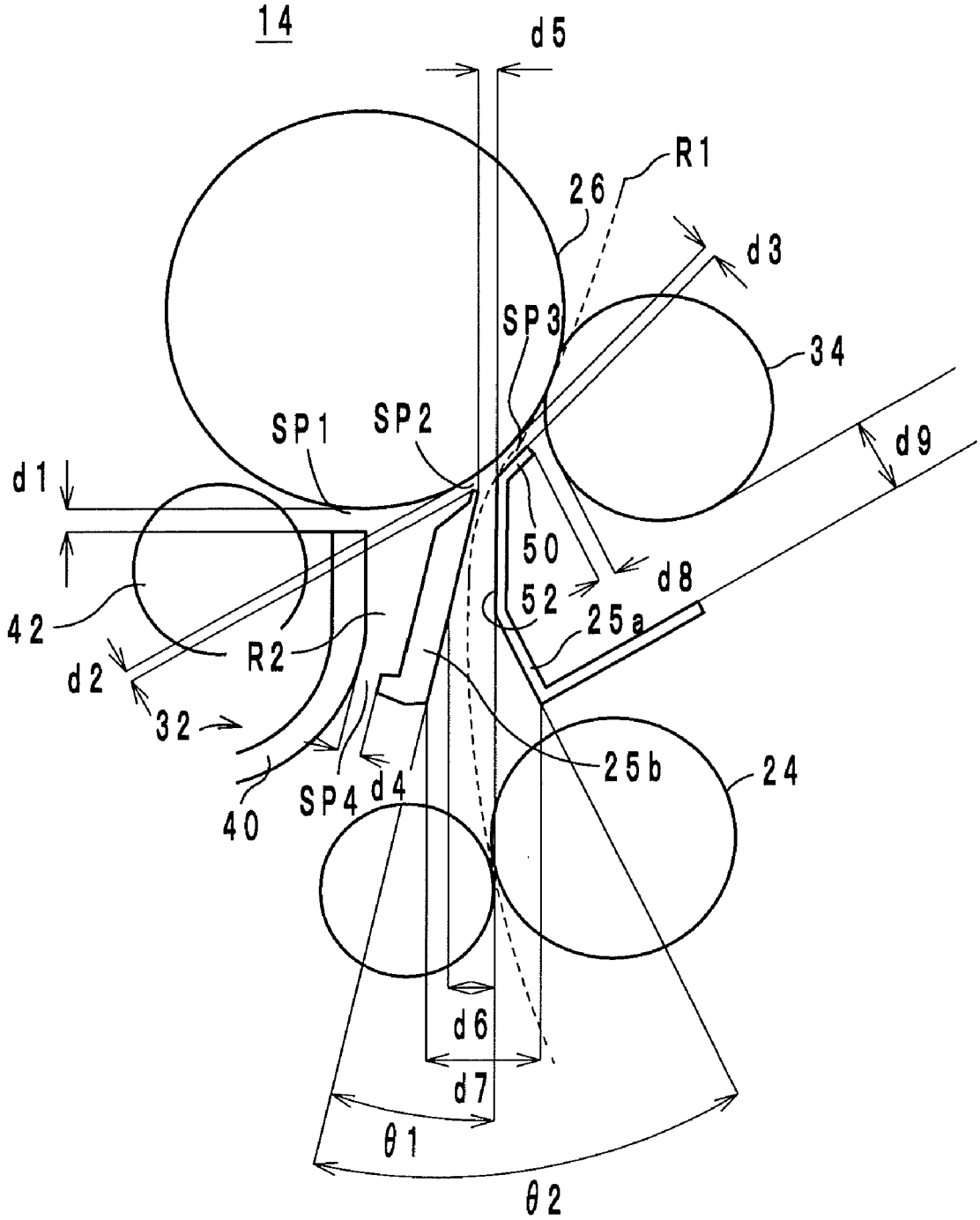
FIG. 4 is an illustration showing the dimensions of various parts of the image forming unit employed in the image forming apparatus according to the embodiment of the present invention.

In order to confirm the effects of the image forming apparatus 10, the inventors carried out computer simulations as described below. FIG. 3 shows a model of an image forming unit 114 employed in an image forming apparatus according to a comparative example. FIG. 4 shows the dimensions of various parts of an image forming unit 14 employed in the image forming apparatus 10 according to the present embodiment.

More specifically, as a model of the image forming apparatus 10 according to the present embodiment, a model as shown by FIG. 2, which will be hereinafter referred to as a first model, was fabricated. As a model of an image forming apparatus 100 according to a comparative example, a model as shown by FIG. 3, which will be referred to as a second model, was fabricated. The difference between the first model and the second model is only that the first model has the gap SP4. In each of the first model and in the second model, 29 toner particles were put in the narrowest portion between the photosensitive drum 26 and the developing roller 42, and the loci of the toner particles were figured out. The analyses were carried out under the following conditions (see FIG. 4).

The software used for the analyses was FLUENT made by ANSYS Japan Co., Ltd.

The toner particles had diameters of 5.0 μm and had densities of 1500 g/m$^3$.

The components of the models had the following operation speeds:

the circumferential speed of the photosensitive drum 26 was 93 mm/s;

the circumferential speed of the transfer roller 34 was 93 mm/s;

the circumferential speed of the developing roller 42 was 165 mm/s;

the circumferential speed of the pair of timing rollers was 93 mm/s; and the air flow rate by the fan was 0.4 m/s.

The components of the models had the following dimensions:

the width d1 of the gap SP1 (the shortest distance between the photosensitive drum 26 and the case 40) was 1.0 mm the width d2 of the gap SP2 (the shortest distance between the guide 25*b* and the photosensitive drum 26) was within the range from 0.5 mm to 1.5 mm;

the width d3 of the gap SP3 (the shortest distance between the edge 50 and the photosensitive drum 26) was 0.9 mm;

the width d4 of the gap SP4 (the shortest distance between the guide 25*b* and the case 40) was 2.0 mm;

the distance d5 between the downstream edge of the guide wall 52 and the downstream edge of the guide 25*b* was 1.5 mm;

the distance d6 between the middle point of the guide wall 52 with respect to the sheet feeding direction and the guide 25*b* was 3.5 mm;

the distance d7 between the upstream edge of the guide wall 52 and the upstream edge of the guide 25*b* was 8.5 mm;

the shortest distance d8 between the guide 25*a* and the transfer roller 34 was 1.2 mm;

the shortest distance d9 between the end of the bent portion of the guide 25*a* and the transfer roller 34 was 5.0 mm;

the angle θ1 of the downstream portion (with respect to the sheet feeding direction) of the guide wall 52 to the guide 25*b* was 14.3 degrees; and the angle θ2 of the upstream portion (with respect to the sheet feeding direction) of the guide wall 52 to the guide 25*b* was 43 degrees.

Figure 5:
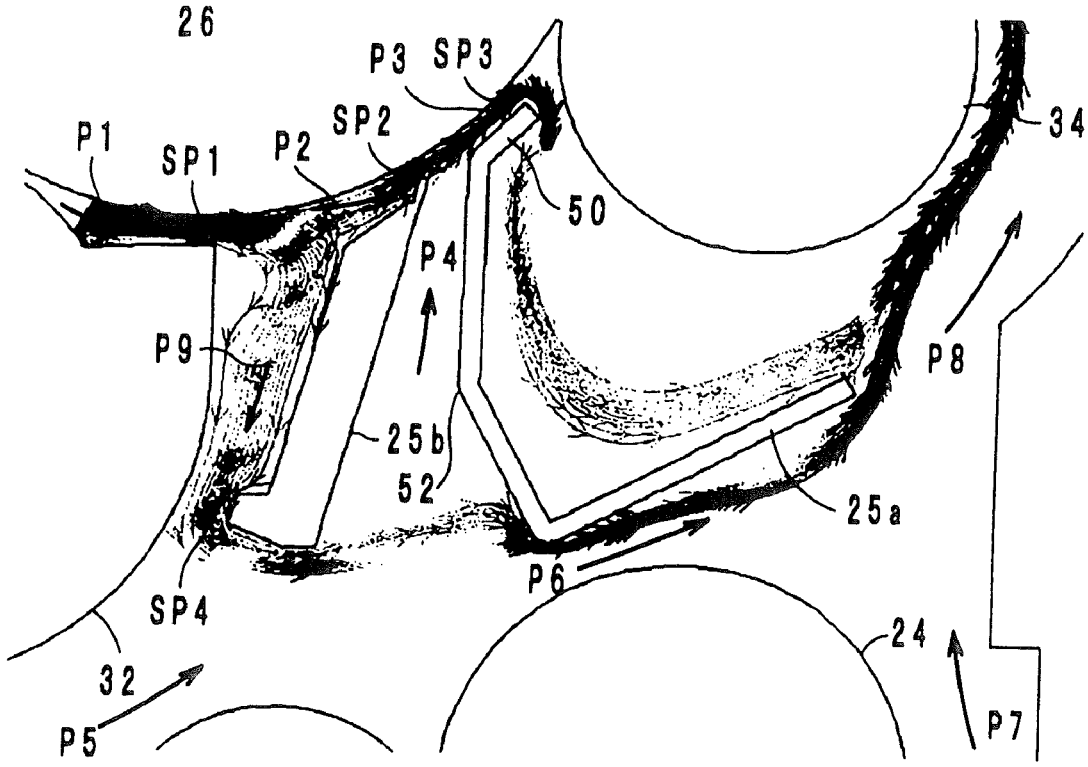
FIG. 5 is an illustration showing the result of an analysis of a first model.
Figure 6:
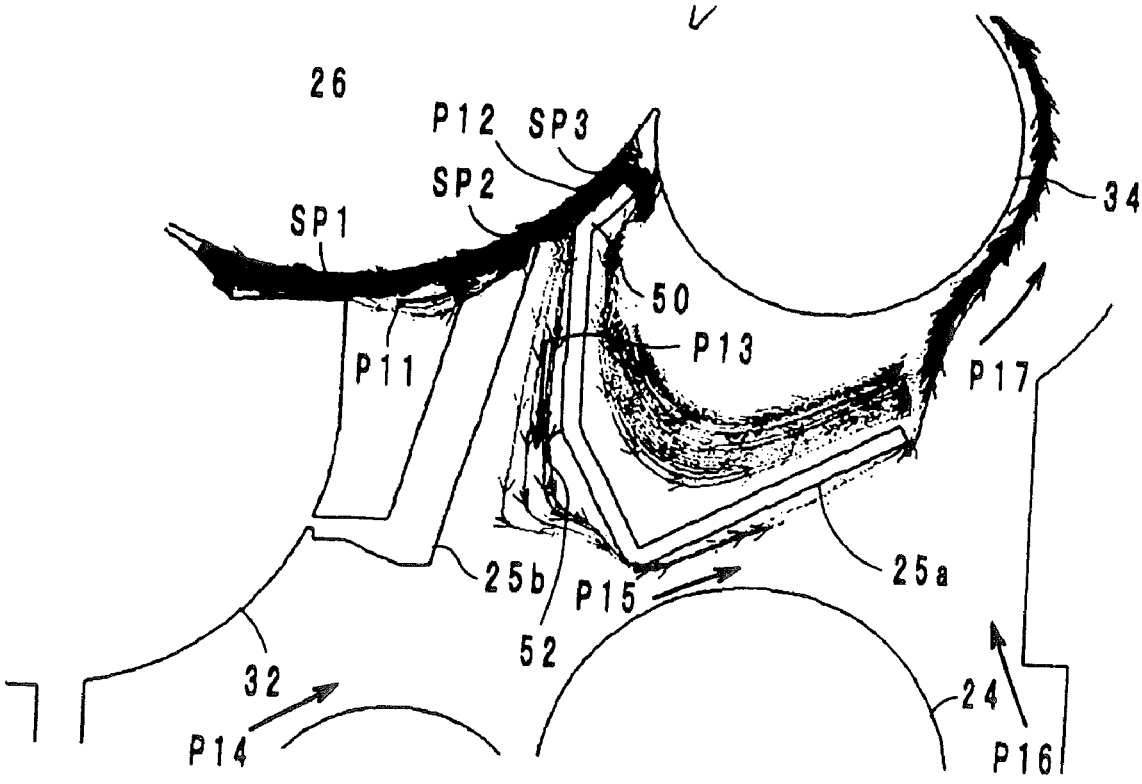
FIG. 6 is an illustration showing the result of an analysis of a second model.

The first model and the second model were operated under the conditions above, and the following results were obtained. FIG. 5 shows the results of the analysis of the first model. FIG. 6 shows the results of the analysis of the second model.

The air flow rates at the points shown in FIG. 5 were as follows: 0.009 m$^3$/min at the point P1; 0.005 m$^3$/min at the point P2; 0.006 m$^3$/min at the point P3; 0.001 m$^3$/min at the point P4; 0.025 m$^3$/min at the point P5; 0.029 m$^3$/min at the point P6; 0.023 m$^3$/min at the point P7; 0.058 m$^3$/min at the point P8; and 0.004 m$^3$/min at the point P9.

The air flow rates at the points shown in FIG. 6 were as follows: 0.008 m$^3$/min at the point P11; 0.006 m$^3$/min at the point P12; 0.002 m$^3$/min at the point P13; 0.026 m$^3$/min at the point P14; 0.028 m$^3$/min at the point P15; 0.024 m$^3$/min at the point P16; and 0.059 m$^3$/min at the point P17.

As is apparent from FIG. 6, since the second model did not have the gap SP4, the air flow F1 did not come into the flow passage R2 and came into the gaps SP2 and SP3. In this second model shown by FIG. 6, also, since the gap SP2 was relatively narrow, part of the air flow F1 leaked out into the sheet path R1 between the guides 25*a* and 25*b*. These results show that in the second model shown by FIG. 6, a large volume of toner may adhere to the guide wall 52 and to the edge 50.

On the other hand, as is apparent from FIG. 5, since the first model had the gap SP4, part of the air flow F1 (that is, the air flow F3) passed through the passage R2 and joined to the air flow F2. Therefore, in the first model shown by FIG. 5, the volume of the air flow F1 that came into the gaps SP2 and SP3 was small, compared with the second model shown by FIG. 6. Consequently, adhesion of a large volume of toner to the edge 50 could be suppressed. Further, since the volume of the air flow F1 coming into the gap SP3 was small, almost no volume of air leaked from the air flow F1 into the sheet path R1 between the guides 25*a* and 25*b*. Consequently, in the first model, toner was prevented from adhering to the guide wall 25.

Thus, as in the first model, by making the gap SP4, toner adhesion to the guide wall 52 and to the edge 50 can be suppressed. Thereby, as will be described later, stains on the reverse sides of sheets can be prevented. In the second model, in the portions of the guide wall 52 and the edge 50 where sheets of a frequently used size (for example, A4-sized sheets) pass through, toner is often wiped away by these sheets. Accordingly, the volume of toner adhering to the reverse side of such a sheet is small, and the sheet is hardly stained with toner.

However, outside of the portions of the guide wall 52 and the edge 50 where sheets of a frequently used size pass through, toner is hardly wiped away and is deposited thereon. Accordingly, when a sheet larger than the frequently used size (for example, an A3-sized sheet) is subjected to printing, the deposited toner adheres to the reverse side of the sheet. Thus, in the second model, sheets of a size larger than the frequently used size are more likely to be stained with toner on the reverse sides when they are subjected to printing than sheets of the frequently used size.

In the first model, on the other hand, because of the gap SP4, the volume of the air flow F1 coming into the gaps SP2 and SP3 is small, and almost no volume of air leaks from the air flow F1 to the sheet path R1 between the guides 25*a* and 25*b*. Thereby, in the first model, toner adhesion to the guide wall 52 and to the edge 50 can be suppressed. Consequently, in the fist model, sheets are less likely to be stained with toner on the reverse sides than in the second model.

Other Embodiments

In the image forming apparatus 10, the area of the portion where the flow passage R2 faces the air flow F2 (that is, the area of the gap SP4) is preferably larger than the area of a section of the portion between the guide 25*b* and the photosensitive drum 26 taken in a direction perpendicular to the arrow "A" (that is, the area of the gap SP1). In this state, part of the air flow F1 is directed to the air flow F2 via the flow passage R2 effectively. Thereby, toner adhesion to the guide 25*b* and to the edge 50 can be suppressed more effectively.

There may be provided a changer for changing the area of the portion where the flow passage R2 faces the air flow F2. It is preferred that the changer operates in accordance with the sheet size.

The developing device 32 is a device for one-component toner. However, the developing device 32 may be a device for two-component toner.

Although the present invention has been described with reference to the embodiment above, it is to be noted that various changes and modifications are possible to those who are skilled in the art. Such changes and modifications are to be understood as being within the scope of the present invention.

What is claimed is:

1. An image forming apparatus comprising:

a photosensitive drum that rotates in a specified direction;

a developing device for forming a toner image on a surface of the photosensitive drum;

a transfer member for transferring the toner image from the photosensitive drum to a printing medium passing between the photosensitive drum and the transfer member;

a first guide, which is disposed in a position downstream from the developing device and upstream from the transfer device with respect to the specified direction to face the photosensitive drum, for guiding the printing medium to between the transfer member and the photosensitive drum;

an air flow generator for generating an air flow passing through a position different from a position where a first air flow along the surface of the photosensitive drum is generated by the rotation of the photosensitive drum; and a flow passage, which is disposed upstream from a path of the printing medium and downstream from the developing device with respect to the specified direction, for directing part of the first air flow to the second air flow.

2. An image forming apparatus according to claim 1, further comprising a second guide that is disposed downstream from the developing device and upstream from the first guide with respect to the specified direction, the first guide and the second guide defining the path of the printing medium, wherein the flow passage is defined by the second guide and a case of the developing device.

3. An image forming apparatus according to claim 2, wherein the air passage has a portion facing the second air flow, the portion having an area larger than an area of a section of a portion between the second guide and the photosensitive drum, the section being taken in a direction perpendicular to the specified direction.

4. An image forming apparatus according to claim 2, wherein the second air flow passes through a position upstream from the first guide and the second guide with respect to a sheet feeding direction.

5. An image forming apparatus according to claim 1, further comprising an area changer for changing the area of the portion where the flow passage faces the second flow.

* * * * *